US005283940A

United States Patent [19]

Luch et al.

[11] Patent Number: 5,283,940

[45] Date of Patent: Feb. 8, 1994

[54] METHOD OF FORMING TAMPER-EVIDENT CONTAINER AND CLOSURE BY CURLING

[75] Inventors: Daniel Luch, Los Gatos; Rawson Chenault, Newark, both of Calif.

[73] Assignee: Portola Packaging, Inc., San Jose, Calif.

[21] Appl. No.: 957,402

[22] Filed: Oct. 6, 1992

Related U.S. Application Data

[62] Division of Ser. No. 741,650, Aug. 7, 1991, Pat. No. 5,163,575.

[51] Int. Cl.[5] ..... B29D 11/02

[52] U.S. Cl. ..... 29/453; 264/295; 264/296

[58] Field of Search ..... 29/453, 450, 451; 264/295, 296, 230

[56] References Cited

U.S. PATENT DOCUMENTS

| | | | |
|---|---|---|---|
| 2,846,831 | 8/1958 | Dobbins | 29/453 X |
| 4,190,175 | 2/1980 | Allen | 220/270 |
| 4,475,274 | 10/1984 | Beckstrom et al. | 29/453 X |
| 4,708,255 | 11/1987 | Thompson | 215/329 |
| 4,709,824 | 12/1987 | Thompson | 215/252 |
| 4,711,364 | 12/1987 | Letica | 220/276 |
| 4,748,735 | 6/1988 | Hayes | 29/453 |
| 4,793,506 | 12/1988 | Thompson | 215/344 |
| 4,811,857 | 3/1989 | Thompson | 215/329 |
| 4,823,967 | 4/1989 | Thompson | 215/222 |
| 4,856,667 | 8/1989 | Thompson | 215/318 |
| 4,872,304 | 10/1989 | Thompson | 53/487 |

*Primary Examiner*—Joseph M. Gorski
*Attorney, Agent, or Firm*—Julian Caplan

[57] ABSTRACT

A thin-walled, wide mouth molded plastic container is provided with a tamper evident band initially molded as a straight-walled cylinder spaced outwardly of the lip of the container and connected thereto by a frangible horizontal bridge. The upper edge of the cylindrical band extends above the level of the container lip. Subsequent to molding and preferably before capping, the band is curled inward by application of a curling tool. The container lid is axially applied, the outer edge of the lid displacing the curled band outward. The resilience of the band and bridge permits outward deflection and immediate restoration of the curl to its initial position. The curl prevents removal of the lid without fracture of the bridge and removal of the tamper-evident band.

4 Claims, 2 Drawing Sheets

METHOD OF FORMING TAMPER-EVIDENT CONTAINER AND CLOSURE BY CURLING

This is a division, of application Ser. No. 07/741,650 filed Aug. 7, 1991 now U.S. Pat. No. 5,163,575.

BACKGROUND OF THE INVENTION

1. Field of the Invention

This invention relates to a new and improved container with a tamper-evident band to retain a closure. More particularly, the invention relates to a thin-walled, wide mouth container having a band attached to its upper peripheral edge which is inwardly curled to retain a cover lid. To remove the lid, the band must be removed, and this makes the container tamper-evident.

2. Description of Related Art

Curling of plastic cylindrical bands is known in the art. For example, applying a concave tool to the edge of a cylindrical plastic member is shown in numerous patents to Thompson, U.S. Pat. Nos. 4,708,255; 4,709,824; 4,793,506; 4,872,304; 4,823,967; 4,811,857; and 4,856,667 being typical. These patents disclose a curled bead which is resilient and is compressed when a screw closure is applied to a container neck. Similar curling techniques are employed in the present invention, but the curled flange is employed f or a totally different purpose, namely, the band curls over the edge of a lid and holds the lid in place until the band is removed.

SUMMARY OF THE INVENTION

The container of the present invention is initially molded with a straight-walled cylindrical band spaced outwardly of, but connected to, the outside of the container body through a frangible line of weakness. Subsequent to molding, a curling tool engages the edge of the band and the tool is formed with a concavity which causes the edge of the band to curl inwardly and downwardly. A lid is applied axially to the container. As the lid engages the curled band, it resiliently forces the band outwardly until the curled portion thereof snaps over the top of the lid. So long as the band is intact, the lid cannot be removed. However, the band may be broken from the container along the line of weakness and thereafter the lid may be removed. Fracture at the line of weakness gives evidence of tampering.

Alternatively, the curling of the tamper-evident band may be performed after the lid is in place.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
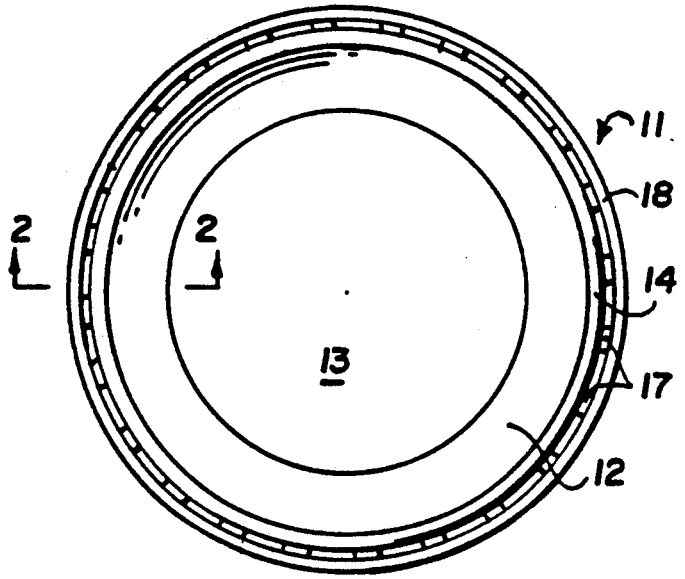
FIG. 1 is a top plan view of a container formed in accordance with the present invention before curling of the tamper-evident band.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Container 11 is subject to wide modification. As here shown, it is depicted as a thin-walled, wide mouth container preferably made of high density polyethylene or polypropylene of the type used for various dairy products such as margarine, cottage cheese, and the like. It will be understood that the details of the structure of the container 11 are subject to wide modification. As illustrated herein, the container 11 has an upwardly-outwardly inclined conical wall 12 and a bottom 13. At the top edge of the wall 12 is an outwardly curled lip 14 which merges in a vertically downwardly extending portion 16. Extending outward from the lower edge of portion 16 are thin, substantially horizontal frangible bridges 17 which constitutes a line (or more precisely, a circle) of weakness. Bridges 17 are preferably interrupted—i.e., made of angularly spaced connections separated by gaps. Extending upward from the bridge 17 is a tamper-evident band 18 which is initially cylindrical as shown in FIG. 2.

Figure 2:
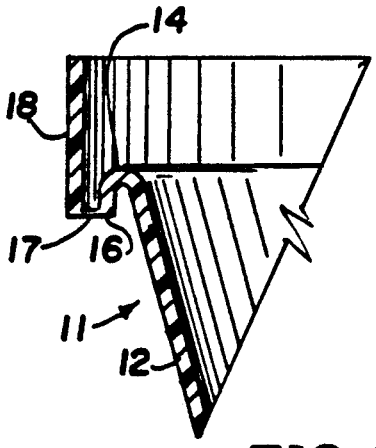
FIG. 2 is a sectional view taken substantially along the line 2—2 of FIG. 1.
Figure 3:
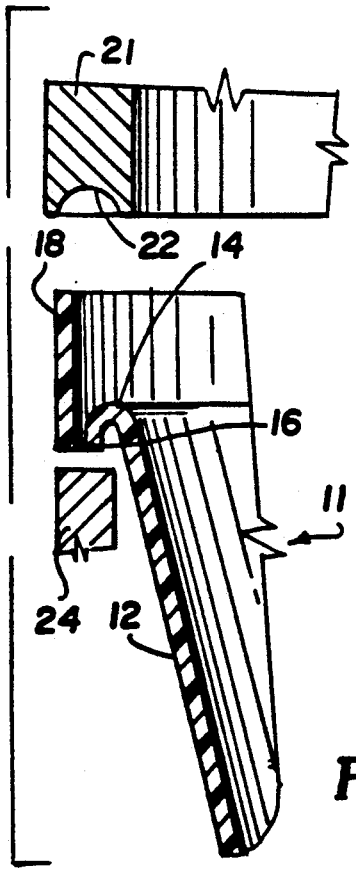
FIG. 3 is a schematic exploded sectional view showing the curling tools immediately before engaging the tamper-evident band.

The container shown in FIG. 2 is modified by the tooling shown in FIG. 3. Above the upper edge of band 18 is a ring-shaped tool 21 having a concavity 22 formed on its lower surface. Below the band 18 is a second reshaped tool 24 which supports the bottom edge of the band 18 and the bridge 17. Tool 21 is brought vertically downwardly and as the upper edge of band 18 engages the concavity 22 it is bent into an inward curl 26 shown in FIG. 4, the curl 26 having a terminus 27 spaced upward from lip 14.

Figure 5:
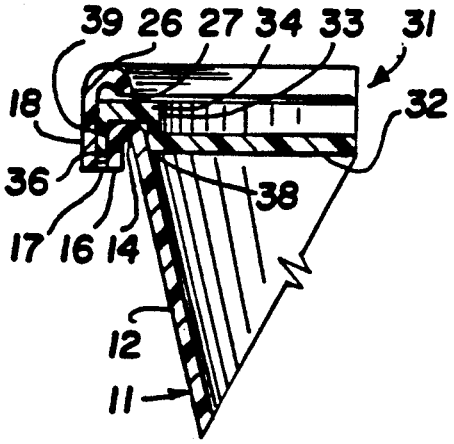
FIG. 5 is a sectional view showing application of the lid.

A lid 31 which may be used with the container 11 is shown in FIG. 5. Such a lid 31 may have a top disc 32 having a diameter less than that of the top of wall 12. The outer edge of disc 32 is formed with an upward-extending edge 33 and extending outward from edge 33 is an annular ring 34 which extends over the lip 14. A downward directed skirt 36 is connected to the outer edge of ring 34.

Figure 4:
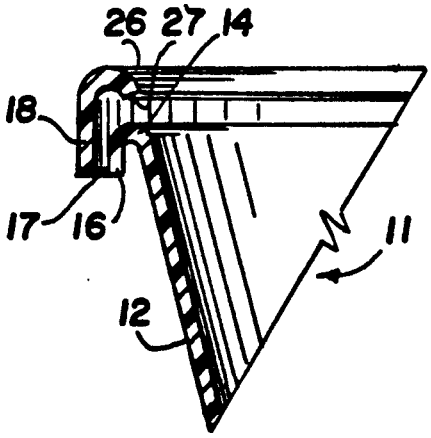
FIG. 4 is a view similar to FIG. 2 showing the curl formed in the upper edge of the band.

Lid 31 may be applied to the container 11 in the condition shown in FIG. 4 by moving the lid 31 vertically downwardly. The bottom edge of skirt 36 engages the curl 26 and bends it outwardly sufficiently so that the lid may pass beyond the curl 26 and seat on the container 11 as shown in FIG. 5. Because of the resilient nature of the bridges 17 and the band 18, the curl 26 returns to the position shown in FIG. 4. As shown in FIG. 5, the curl 26 thus encases the ring 34 of lid 31, holding the same in position. The container is sealed by circles of contact 38 between the upward extending edge 33 and the inside of the wall 12 and by the circle of contact 39 between the underside of the ring 34 and the top of lip 14.

The lid 31 may not be removed so long as the curl 26 engages the ring 34. If one attempts to remove the lid, bridges 17 breaks, giving evidence of tampering. When the consumer wishes to open the container, band 18 is broken away by fracturing bridges 17. By prying upward on the bottom edge of skirt 36, the user may remove the lid 31. Lid 31 is reclosable since it is merely necessary to force it onto the lip 14 if desired.

Figure 6:
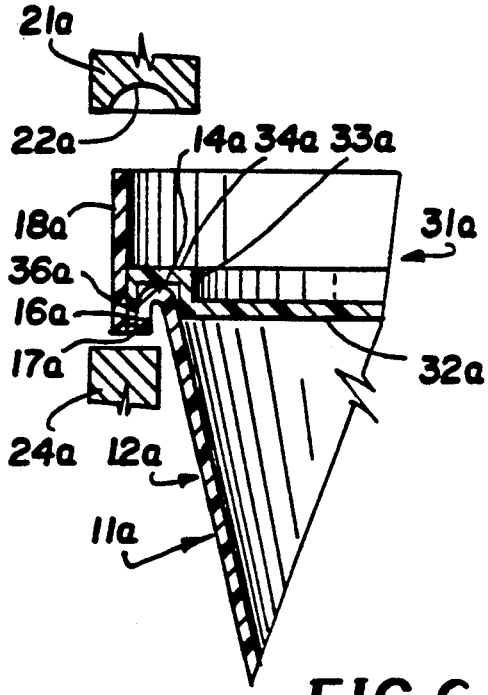
FIG. 6 is a view similar to FIG. 3 showing a modification wherein the lid is applied before curling the tamper-evident band.
Figure 7:
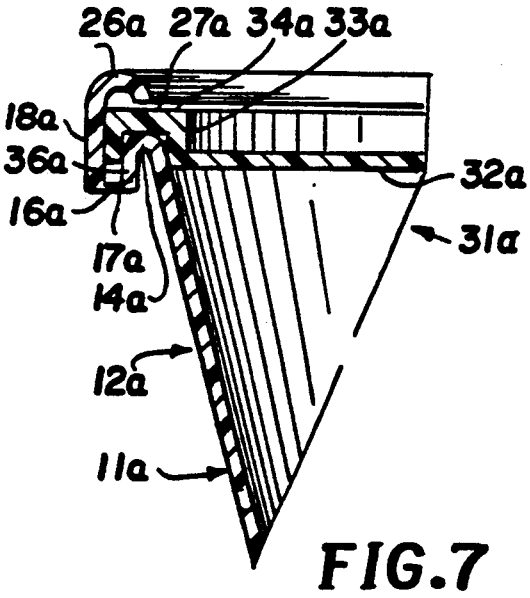
FIG. 7 is a view similar to FIG. 6 showing completion of the curling operation.

In the modification of FIGS. 6 and 7, lid 31*a* is applied to the container 11*a* before the band 18*a* is curled. After application of lid 31*a*, tools 21*a* and 24*a* perform the curling operation.

In other respects the modification of FIGS. 6 and 7 resembles that of the preceding modification and the same reference numerals followed by the subscript a indicated corresponding elements.

In the foregoing description and following claims the terms "circle", "ring" or "cylinder" have been used. It will be understood, however, that the container may be oval, rectangular or other non-circular shapes. The terms will be understood in accordance with this paragraph.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method of forming a tamper-evident closure of a container with a lid, comprising the steps of providing a molded plastic container formed of a curlable material having a wall formed with an upper lip having an uppermost edge, an initially cylindrical tamper-evident band having an initial diameter and an upper end spaced outwardly and extending above said lip and frangible means joining said band to said wall adjacent said lip, axially applying a curling tool to said upper end of said band, thereby forming an inward-downward curl in excess of 90° to said band, said curl having a lowermost edge opposed to an spaced above said uppermost edge, providing a lid having the outside diameter greater than an outside diameter of said lip and less than an initial diameter of said band, forcing said lid axially downward toward said container, thereby causing said lid to resiliently displace said curl outward, said lid to engage said lip, and said curl to return to its initial position with said lowermost edge spaced above said lid, whereby said lid cannot be removed without fracturing said frangible means and removing said tamper-evident band.

2. The method of claim 1 in which said container and lid having cooperative seal means and which further comprises interengaging said lid and container when said lid is engaged with said lip.

3. A method of forming a tamper-evident package comprising a container and a lid, said method comprising the steps of:

providing a molded plastic container formed with a body comprising a wall having an uppermost edge, an initially cylindrical tamper-evidencing band of a curlable and resilient material having an initial diameter and an upper end spaced outwardly from said uppermost edge and frangible means frangibly joining said band to said body adjacent said uppermost edge, axially applying a curling tool to said upper end of said band, thereby forming an inward-downward directed curl in excess of 90° to said band, said curl having a lowermost edge, providing a lid having an outside diameter greater than an outside diameter of said wall and less than the initial diameter of said band, forcing said lid to axially downward toward said container, thereby causing said lid resiliently displace said curl outward, said lid to engage said uppermost edge, and said curl to return to its initial position with said lowermost edge spaced above a portion of said lid, whereby said lid cannot be removed without fracturing said frangible means and removing said tamper-evident band.

4. The method of claim 3 in which said container and lid have cooperative seal means and which further comprises interengaging said lid and container to seal said package when said lid is engaged with said uppermost edge.

* * * * *